US009453665B1

(12) United States Patent
OQuinn et al.

(10) Patent No.: US 9,453,665 B1
(45) Date of Patent: Sep. 27, 2016

(54) HEAT POWERED REFRIGERATION SYSTEM

(71) Applicant: Cormac, LLC, Checotah, OK (US)

(72) Inventors: Dwight OQuinn, Checotah, OK (US); George O'Quinn, San Jose, CA (US); Joel Whitman, Checotah, OK (US)

(73) Assignee: Cormac, LLC, Checotah, OK (US)

( * ) Notice: Subject to any disclaimer, the term of this patent is extended or adjusted under 35 U.S.C. 154(b) by 0 days.

(21) Appl. No.: 15/154,200

(22) Filed: May 13, 2016

(51) Int. Cl.
*F25B 29/00* (2006.01)
*F25B 41/00* (2006.01)

(52) U.S. Cl.
CPC ..... *F25B 29/003* (2013.01); *F25B 41/00* (2013.01)

(58) Field of Classification Search
CPC ..... F25B 29/003; F25B 41/00; F25B 30/00; F25B 30/02
USPC ..... 62/178, 238.7, 298
See application file for complete search history.

(56) References Cited

U.S. PATENT DOCUMENTS 2,242,588 A * 5/1941 McGrath ..... F24D 11/0257 236/91 R
2,305,162 A * 12/1942 Holmes ..... F25B 11/00 62/117
2,938,844 A * 5/1960 Graham ..... G21C 1/26 376/221
3,995,428 A 12/1976 Roberts
4,201,058 A * 5/1980 Vaughan ..... F01K 23/14 60/618
4,321,797 A * 3/1982 Yaeger ..... F24D 17/02 62/238.6
4,400,950 A * 8/1983 Knabben ..... F24D 11/0214 62/238.6
4,481,783 A * 11/1984 Pecz ..... F25B 9/006 62/101
5,027,602 A 7/1991 Glen et al.
5,044,166 A 9/1991 Wijmans et al.
8,794,003 B2 8/2014 Mauran et al.
2004/0237527 A1* 12/2004 Kato ..... F01K 9/003 60/670
2006/0060326 A1* 3/2006 Halfmann ..... F24F 1/022 165/11.1
2006/0117783 A1* 6/2006 Solomon ..... F02B 71/00 62/324.1
2006/0242992 A1 11/2006 Nicodemus (Continued)

FOREIGN PATENT DOCUMENTS

CN 2569049 8/2003
EP 1620684 10/2007
WO 0157454 8/2001
WO 2003106900 12/2003
WO 2012131860 10/2012

OTHER PUBLICATIONS

Tchanche; Fluids in Low Temperature Thermodynamic Power Cycles; 3rd International Exergy, Life Cycle Assessment, and Sustainability Workshop & Symposium (ELCAS3); Jul. 7-9, 2013, Nisyros—Greece.

(Continued)

*Primary Examiner* — Mohammad M Ali
(74) *Attorney, Agent, or Firm* — Head, Johnson & Kachigian, P.C.

(57) ABSTRACT

A refrigeration system comprising a refrigeration side, a heat engine side, and a diaphragm assembly between the refrigeration side and the heat engine side. The diaphragm assembly may comprise a diaphragm separating refrigerant fluid from engine fluid, where the diaphragm is flexible such that when the refrigerant fluid has a higher pressure than the engine fluid, the diaphragm forces the engine fluid out of the diaphragm assembly and when the engine fluid has a higher pressure than the refrigerant fluid, the diaphragm forces the refrigerant fluid out of the diaphragm assembly. The refrigerant fluid may be propane and the engine fluid may be butane.

11 Claims, 2 Drawing Sheets

(56) References Cited

U.S. PATENT DOCUMENTS

| | | | | |
|---|---|---|---|---|
| 2008/0156373 | A1* | 7/2008 | Smith | F04F 1/04 137/14 |
| 2008/0319587 | A1* | 12/2008 | Cowans | F25B 41/00 700/299 |
| 2009/0293515 | A1* | 12/2009 | Lifson | F24D 17/02 62/117 |
| 2010/0083675 | A1* | 4/2010 | Merritt | E03B 3/28 62/93 |
| 2012/0312042 | A1* | 12/2012 | Jeong | F24D 19/0095 62/207 |
| 2013/0084474 | A1* | 4/2013 | Mills | H01M 4/9016 429/9 |
| 2014/0260357 | A1* | 9/2014 | Marte | F25B 29/003 62/79 |

OTHER PUBLICATIONS

Pridasawas; Solar-Driven Refrigeration Systems with Focus on the Ejector Cycle; Doctoral Thesis; Stockholm, Oct. 2006.

Choudhary; Performance Analysis of the Blends of Hydrocarbons Mixed With Lpg as Modem Eco Friendly Refrigerant; International Journal of Core Engineering & Management (IJCEM) vol. 2, Issue 7, Oct. 2015.

Dhankhar; A Study on Refrigeration; International Journal of Science and Research (IJSR); vol. 3 Issue 5, May 2014.

Chen; Effect of heat transfer law on the finite-time exergoeconomic performance of a Carnot refrigerator; Exergy; accepted May 15, 2000.

Chen; Study on optimal performance and working temperatures of endoreversible forward and reverse carnot cycles; International Journal on Energy Research; Dec. 1995.

* cited by examiner

HEAT POWERED REFRIGERATION SYSTEM

BACKGROUND OF THE INVENTION

Cross Reference

Not Applicable.

FIELD OF THE INVENTION

This invention relates generally to a refrigeration system and more particularly, but not by way of limitation, to a refrigeration system that is powered by heat.

DESCRIPTION OF THE RELATED ART

Refrigeration systems, such as air conditioner, refrigerators, and freezers, require energy. Solar energy and waste heat energy are readily available, but past attempts to utilize such energy to power refrigeration systems have been problematic. For ammonia absorption system and lithium bromide absorptions systems were tied with solar systems, but have been phased out due to high maintenance, lack of qualified service people, and the cost of natural gas.

Based on the foregoing, it is desirable to provide a refrigeration system that is powered by heat.

It is further desirable for such a system to utilize solar energy to power the refrigeration system.

It is further desirable for such a system to alternately utilize waste heat energy to power the refrigeration system.

SUMMARY OF THE INVENTION

In general, in a first aspect, the invention relates to a refrigeration system comprising a refrigeration side, a heat engine side, and a diaphragm assembly between the refrigeration side and the heat engine side. The refrigeration side may comprise an evaporator, a condenser, and a refrigerant fluid, while the heat engine side may comprise a boiler, a condenser, and an engine fluid. On the refrigeration side, the evaporator may be in fluid communication with the diaphragm assembly, the diaphragm assembly may be in fluid communication with the condenser, and the condenser may be in fluid communication with the evaporator such that the refrigerant fluid flows from the evaporator to the diaphragm assembly, from the diaphragm assembly to the condenser, and from the condenser to the evaporator. On the heat engine side, the boiler may be in fluid communication with the diaphragm assembly, the diaphragm assembly may be in fluid communication with the condenser, and the condenser may be in fluid communication with the boiler such that the engine fluid flows from the boiler to the diaphragm assembly, from the diaphragm assembly to the condenser, and from the condenser to the boiler. The diaphragm assembly may comprise a diaphragm separating the refrigerant fluid from the engine fluid, where the diaphragm is flexible such that when the refrigerant fluid has a higher pressure than the engine fluid, the diaphragm forces the engine fluid out of the diaphragm assembly and when the engine fluid has a higher pressure than the refrigerant fluid, the diaphragm forces the refrigerant fluid out of the diaphragm assembly. The refrigerant fluid and the engine fluid may be related such that the refrigerant fluid has a higher pressure at the evaporator than the engine fluid has at the condenser and the engine fluid has a higher pressure at the boiler than the refrigerant fluid has at the condenser. For example, the refrigerant fluid may be propane and the engine fluid may be butane.

The refrigeration system may further comprise a heat source, where the heat source supplies heat to the boiler. The heat source may be solar heat or waste heat.

The diaphragm assembly may comprises: the diaphragm; a refrigeration side cylinder head; an engine side cylinder head; a refrigeration side valve, where the refrigeration side valve is in fluid communication with the refrigeration side cylinder head, the refrigeration side condenser, and the evaporator such that the refrigeration side valve controls whether fluid may travel from the evaporator to the refrigeration side cylinder head or from the refrigeration side cylinder head to the condenser; and an engine side valve, where the engine side valve is in fluid communication with the engine side cylinder head, the engine side condenser, and the boiler such that the engine side valve controls whether fluid may travel from the boiler to the engine side cylinder head or from the engine side cylinder head to the condenser. The diaphragm may be located between and may sealingly separate the refrigeration side cylinder head and the engine side cylinder head.

The refrigeration system may further comprise a gravity flow system between the engine side condenser and the boiler.

In a second aspect, the invention relates to a method of using heat to power the refrigeration system described above. The method may comprise: applying heat to the boiler; heating the engine fluid with the boiler; moving the engine side valve to allow the engine fluid to flow from the boiler to the diaphragm assembly and simultaneously moving the refrigeration side valve to allow the refrigerant fluid to flow from the diaphragm assembly to the refrigeration side condenser; allowing the pressure of the heated engine fluid to move the diaphragm to a first position, forcing refrigerant fluid out of the diaphragm assembly to the refrigeration side condenser; moving the engine side valve to allow the engine fluid to flow from the diaphragm assembly to the engine side condenser and simultaneously moving the refrigeration side valve to allow the refrigerant fluid to flow from the evaporator to the diaphragm assembly; allowing the pressure of the refrigerant fluid to move the diaphragm to a second position, forcing engine fluid out of the diaphragm assembly to the engine side condenser; allowing the engine fluid to return to the boiler; and repeating all steps.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
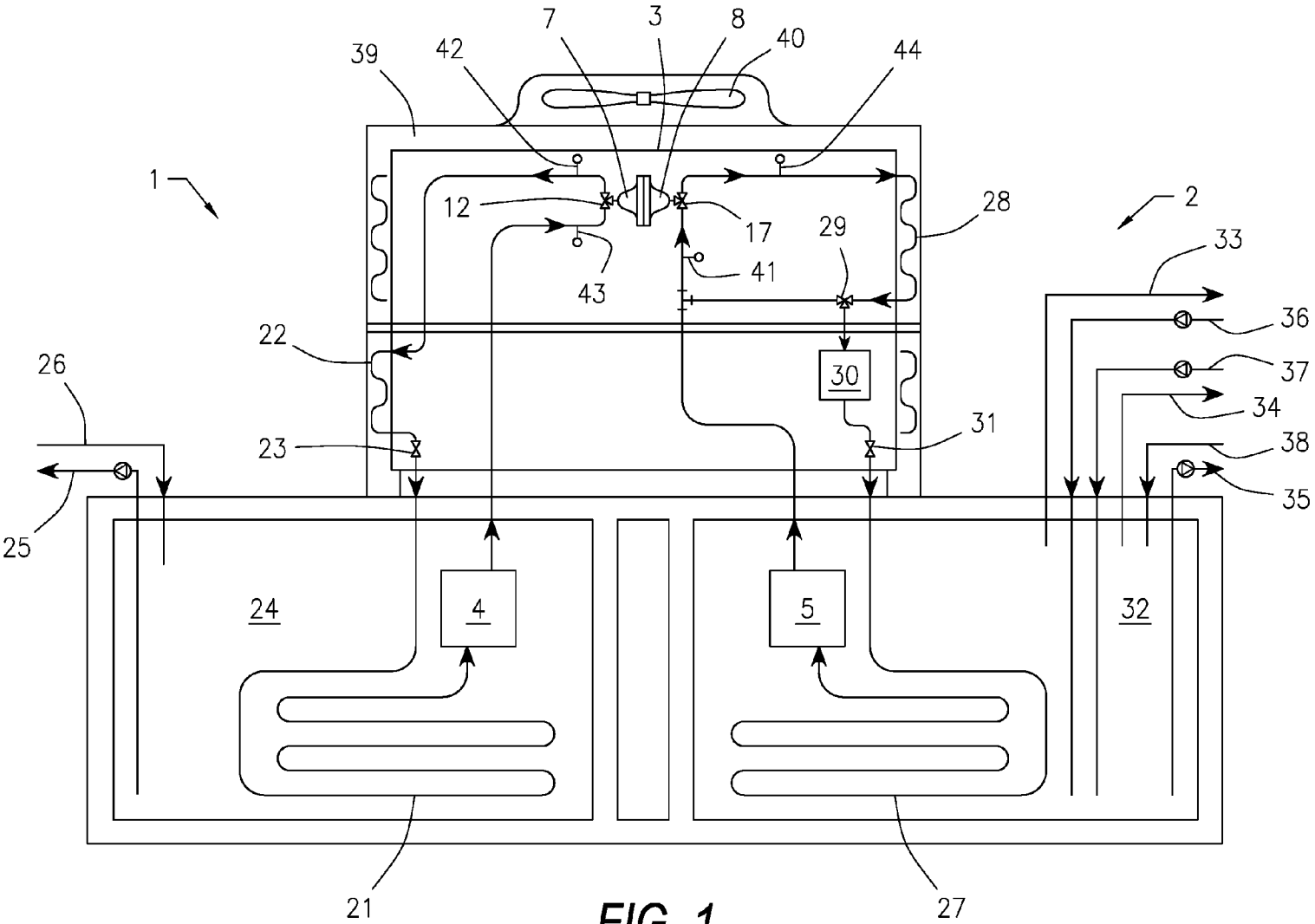
FIG. 1 is a schematic view of the heat powered refrigeration system.

In general, in a first aspect, the invention relates to a heat powered refrigeration system. An example of the system is shown in FIG. 1. The system may have a refrigeration side 1 and a heat engine side 2. The two sides 1 and 2 may interact through a diaphragm assembly 3, an example of which is shown in detail in FIG. 2. The system may pair two fluids with unique thermodynamic properties, with a refrigerant fluid 4 used on the refrigeration side 1 and an engine fluid 5 used on the engine side 2. For example, the refrigerant fluid 4 may be propane and the engine fluid 5 may be butane.

The thermodynamic properties to be considered may be the temperature and pressure relationships of the refrigerant fluid 4 on the refrigeration side 1 and the engine fluid 5 on the engine side 2. In particular, the refrigeration evaporator pressure may be greater than the engine condenser pressure, and the engine boiler pressure may be greater than the refrigeration condenser pressure. Assuming 100° F. ambient air temperature and 20° F. temperature difference from the working condensing fluids to the outside air, the condensing temperatures would be 120° F. Assuming an indoor air temperature of 78° F. and a 19° F. temperature difference from the air-conditioning fluid to the indoor air, the A/C fluid would be 59° F. Assuming another 19° F. temperature difference from the A/C fluid to the refrigeration evaporator fluid, the temperature would be 40° F. Using these pressure relationships and temperature assumptions, suitable pairs of refrigeration fluids may be as follows:

R600 and R404A
R600 and R407C
R124 and R32
R152A and R123
R600A and R125
R125 and R124
R124 and R407
R600 and R290
R600 and R22
R123 and R12
R600A and R404A
R404A and R124
R124 and R507A
R600A and R507A
R245FA and R12
R245FA and R22
R245FA and R134A One suitable pair, as noted above, is normal butane (R600) for the engine fluid and propane (R290) for the refrigeration fluid. Using propane, the refrigeration evaporator pressure at 40° F. is 78 PSIA which is greater than the butane engine condenser pressure at 120° F. is 70 PSIA. The butane boiler pressure at 230° F. is 268 PSIA which is greater than the propane refrigeration condenser temperature at 120° F. is 242 PSIA.

R600 and R290 appear to be the most environmentally friendly.

The diaphragm assembly 3 may comprise a diaphragm 6, a refrigeration side cylinder head 7, and an engine side cylinder head 8. The two cylinder heads 7 and 8 may be aligned along their edges. The refrigeration side cylinder head 7 may be convex toward the refrigeration side 1 of the system, while the engine side cylinder head 8 may be convex toward the engine side 2 of the system, such that the two cylinder heads 7 and 8 form a chamber therebetween. Each of the cylinder heads 7 and 8 may have at least one flanges 9 extending outward therefrom, as shown, such that the flange 9 of cylinder head 7 may align with and be attached to the flange 9 of cylinder head 8, ensuring that the chamber formed between the cylinder heads 7 and 8 is sealed.

Figure 2:
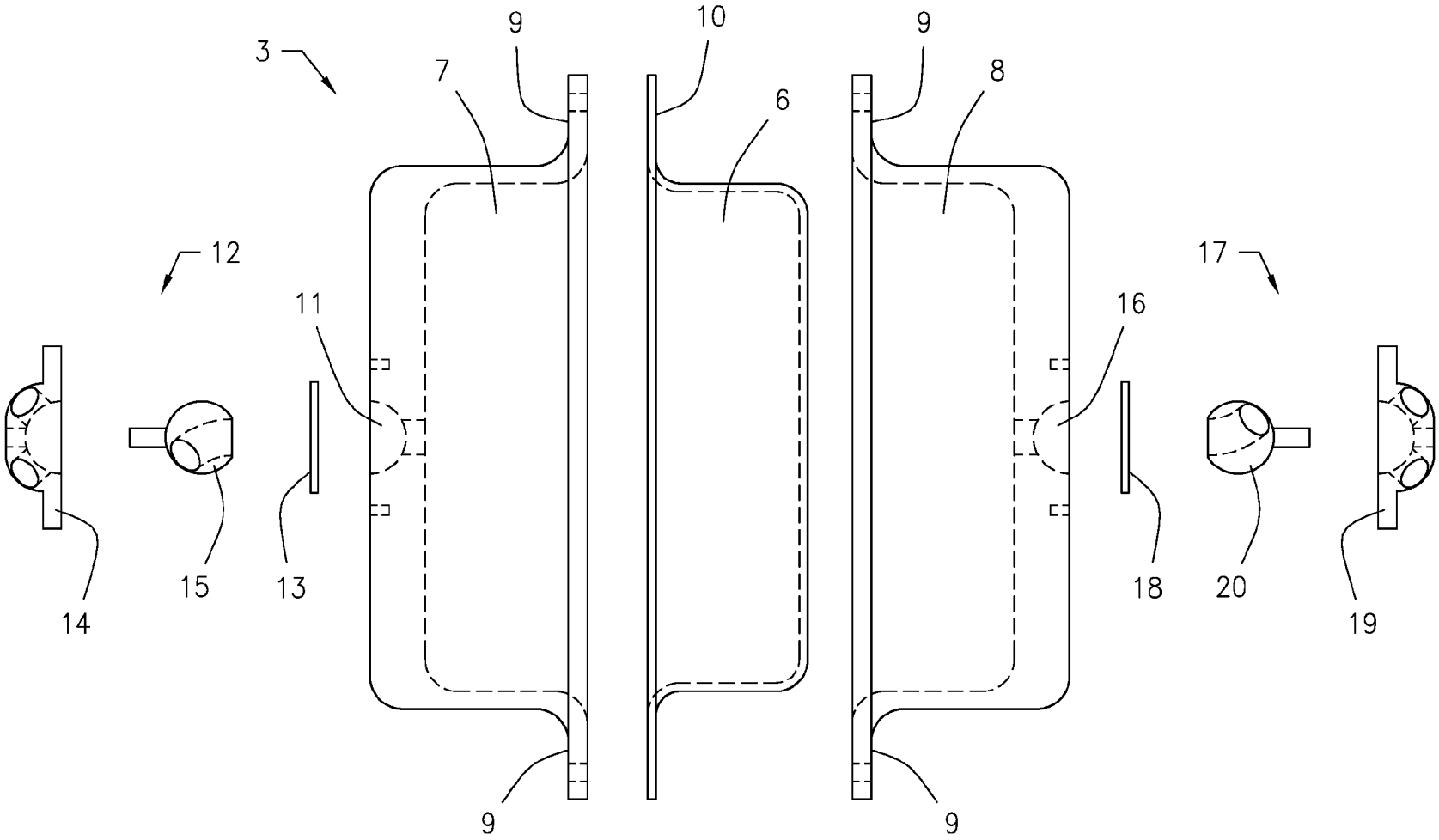
FIG. 2 is a side exploded view of the diaphragm assembly of the heat powered refrigeration system.

The diaphragm 6 may be located between the two cylinder heads 7 and 8. The diaphragm 6 may be flexible and may be sufficiently sized and shaped such that it can move between the interior walls of the two cylinder heads 7 and 8. When the diaphragm 6 is flexed toward the refrigeration side cylinder head 7, in a first position, it may extend to or close to the interior wall of cylinder head 7, such that the volume of space between the diaphragm 6 and the refrigeration side cylinder head 7 is less than the volume between the diaphragm 6 and the engine side cylinder head 8. Indeed, in this position, the volume between the diaphragm 6 and the refrigeration side cylinder head 7 may be at or near zero. Conversely, when the diaphragm 6 is flexed toward the engine side cylinder head 8, in a second position, it may extend to or close to the interior wall of cylinder head 8, such that the volume of space between the diaphragm 6 and the engine side cylinder head 8 is less than the volume between the diaphragm 6 and the refrigeration side cylinder head 7. Indeed, in this position, the volume between the diaphragm 6 and the engine side cylinder head 8 may be at or near zero. The second position is shown in FIG. 2.

The diaphragm 6 may be impermeable or sufficiently impermeable that neither the refrigerant fluid 4 nor the engine fluid 5 may cross the diaphragm 6. The diaphragm 6 may have one or more flange 10 extending radially therefrom such that the flange 10 may be secured between the flanges 9 of the cylinder heads 7 and 8, thus securing the diaphragm 6 in place relative to the cylinder heads 7 and 8.

The refrigeration side cylinder head 7 may have an opening 11 housing a valve assembly 12. The space between the opening 11 and the valve assembly 12 may be sealed, such as by an O-ring 13, as shown, to prevent leakage. The assembly 12 may be a ball valve assembly, as shown, comprising a body 14 and a ball 15. The assembly 12 may be a three-way valve, as shown. Similarly, the engine side cylinder head 8 may have an opening 16 housing a valve assembly 17. The space between the opening 16 and the valve assembly 17 may be sealed, such as by an O-ring 18, as shown, to prevent leakage. The assembly 17 may be a ball valve assembly, as shown, comprising a body 19 and a ball 20. The assembly 17 may be a three-way valve, as shown.

The refrigerant side 1 may comprise an evaporator coil 21, a condenser coil 22, and a valve 23. The evaporator coil 21 and the condenser coil 22 may both be in fluid communication with the refrigeration side cylinder head 7 via valve assembly 12, while the condenser coil 22 may be in fluid communication with the evaporator coil via valve 23. Valve 23 may be a metering valve. During use, the refrigerant fluid 4 may flow through the valve assembly 12 to the refrigeration side cylinder head 7, through the valve assembly 12 to the condenser coil 22, and through valve 23 to the evaporator coil 21. The evaporator coil 21 may be surrounded by a container 24 containing cold liquid, which may travel away from the system for use at or near the bottom of container 24, as shown via line 25, and which may be returned to the system after use at or near the top of the container 24, as shown via line 26. The bulk of the evaporator coil 21 may be located at or near the bottom of the container 24.

The heat engine side 2 may comprise a boiler coil 27, a condenser coil 28, a valve 29, a liquid receiver 30, and a valve 31. The boiler coil 27 and the condenser coil 28 may both be in fluid communication with the engine side cylinder head 8 via valve assembly 17, while the boiler coil 27 and the condenser coil 28 may both be in communication with the liquid receiver 30 via the valve 29, which may be a three way valve. The liquid receiver 30 may be in fluid communication with the boiler coil 27 via valve 31. During use, engine fluid 5 may flow through the valve assembly 17 to the engine side cylinder head 8 and/or through valve 29 to the liquid receiver 30. Engine fluid 5 from the engine side cylinder head 8 may flow through the valve assembly 17 to the condenser coil, then through valve 29 to the liquid receiver 30. Engine fluid 5 in the liquid receiver 30 may flow through valve 31 to the boiler coil 27. The boiler coil 27 may be surrounded by a container 32 containing hot liquid, which may travel away from the system for use from at or near the top of container 32, as shown via lines 33 and/or 34, and which may be returned to the system after use at or near the bottom of container 32, as shown via lines 36 and/or 37. Hot liquid from an external heat source may be added to the container 32, as shown via line 38, and removed for further heating via line 35. The bulk of the boiler coil 27 may be located at or near the bottom of container 32.

The diaphragm assembly 3, condenser coil 22, and condenser coil 28 may be housed in a condenser housing 39, which may be equipped with a condenser fan 40. Valves 12, 17, 23, 29, and 31 may also be housed in the condenser housing 39, along with the liquid receiver 30, as shown. Alternately, condenser coil 22 and condenser coil 28 and their related elements may be housed in separate condenser housings, as desired.

During use, engine fluid 5 in the boiler coil 27 may be heated such that the pressure between the boiler coil 27 and valve 17, such as at point 41, is higher than the pressure between valve 12 and the condenser coil 22 on the refrigeration side 1, such as at point 42. Valve 17 may be opened between the boiler coil 27 and the diaphragm assembly 3, allowing heated engine fluid 5 from the boiler coil 27 into the diaphragm assembly 3. At the same time, valve 12 may be opened between the diaphragm assembly 3 and the condenser coil 22. The higher pressure of the engine fluid 5 may force the diaphragm 6 into the first position, expelling any refrigeration fluid 4 in the diaphragm assembly 3 and causing it to move toward the condenser coil 22.

Next, valve 17 may be closed between the boiler coil 27 and the diaphragm assembly 3 and opened between the diaphragm assembly 3 and the condenser coil 28. Valve 12 may simultaneously be closed between the diaphragm assembly 3 and the condenser coil 22 and opened between the evaporator coil 21 and the diaphragm assembly 3. The pressure of the refrigerant fluid 4 may be higher between the evaporator coil 21 and valve 12, such as at point 43, than the pressure of the engine fluid 5 between valve 17 and the condenser coil 28, such as at point 44. Thus, the higher pressure of the refrigerant fluid 4 may force the diaphragm 6 into the second position, expelling the engine fluid 5 from the diaphragm assembly 3 and causing it to move toward the condenser coil 28. The cycle may then repeat.

On the engine side 2, as the engine fluid 5 is heated, it may pass from a liquid to a gaseous phase. The gas may enter the diaphragm assembly 3, as described above, to move the refrigerant fluid 4 through the refrigeration side 1, and then be expelled, also as described above, to the condenser coil 28. The engine fluid 5 may pass from the gaseous back to the liquid phase in the condenser before returning to the boiler coil 27 to repeat the process. The liquid engine fluid 5 may return to the boiler via a gravity flow system, as shown. The gravity flow system may comprise valve 29, which may be a three way valve, valve 31, and liquid receiver 30. At the start of operation, valve 29 may be open to the condenser 28 and closed to the boiler coil 27 and valve 31 may be closed, allowing liquid engine fluid 5 to drain from the condenser coil 28 into the liquid receiver 30. After a predetermined number of cycles, valve 29 may be closed to the condenser coil 28 and opened to the boiler coil 27, allowing pressures in the boiler and liquid receiver 30 to equalize and the liquid engine fluid 5 in the liquid receiver 30 to drain into the boiler coil 27. The process may then repeat. Alternately, the gravity flow system may be replaced with a boiler feed pump and check valve.

On the refrigeration side 1, refrigerant fluid 4 may travel through the condenser, where it cools and condenses to a liquid phase, before passing through the metering valve 23 to the evaporator coil 21. As the refrigerant fluid 4 evaporates, it may remove heat from the cold liquid in container 24 before being drawn back into the diaphragm assembly 3 due to the lower pressure at point 44 than at point 43, and the cycle may repeat.

This process may be repeated continuously, thus moving the refrigerant fluid 4 through the refrigeration side 1. The system may utilize any desired heat source to drive the engine side 2, such as waste heat or solar heat. The system may be applied to air conditioning, refrigerators, or freezers with temperatures down to 0° F. using multistages of the device, or any other refrigeration system. Additionally or alternately, the system may be applied to heating, water heaters, or any other heating system. The system may be used with photovoltaics, which are currently about 15% efficient commercially, leaving 85% of the solar energy as waste heat, which may be used by the system. Another use of the system is in automobiles, where waste heat from the engine may be used to provide air conditioning.

The heat powered refrigeration system discussed herein may have a life expectancy of 50 years with proper manufacturing, maintenance, and service. The manufacturing may only require simple existing technologies. Any qualified refrigeration service tech may be able to provide service and maintenance.

Whereas, the devices and methods have been described in relation to the drawings and claims, it should be understood that other and further modifications, apart from those shown or suggested herein, may be made within the spirit and scope of this invention.

What is claimed is:

1. A refrigeration system comprising:

a refrigeration side, the refrigeration side comprising:
- an evaporator;
- a condenser; and
- a refrigerant fluid;

a heat engine side, the heat engine side comprising:
- a boiler;
- a condenser; and
- an engine fluid; and a diaphragm assembly between the refrigeration side and the heat engine side, where:

on the refrigeration side, the evaporator is in fluid communication with the diaphragm assembly, the diaphragm assembly is in fluid communication with the condenser, and the condenser is in fluid communication with the evaporator such that the refrigerant fluid flows from the evaporator to the diaphragm assembly, from the diaphragm assembly to the condenser, and from the condenser to the evaporator;

on the heat engine side, the boiler is in fluid communication with the diaphragm assembly, the diaphragm assembly is in fluid communication with the condenser, and the condenser is in fluid communication with the boiler such that the engine fluid flows from the boiler to the diaphragm assembly, from the diaphragm assembly to the condenser, and from the condenser to the boiler; and where the diaphragm assembly comprises a diaphragm separating the refrigerant fluid from the engine fluid, where the diaphragm is flexible such that when the refrigerant fluid has a higher pressure than the engine fluid, the diaphragm forces the engine fluid out of the diaphragm assembly and when the engine fluid has a higher pressure than the refrigerant fluid, the diaphragm forces the refrigerant fluid out of the diaphragm assembly.

2. The refrigeration system of claim 1 where the refrigerant fluid and the engine fluid are related such that the refrigerant fluid has a higher pressure at the evaporator than the engine fluid has at the condenser and the engine fluid has a higher pressure at the boiler than the refrigerant fluid has at the condenser.

3. The refrigeration system of claim 2 where the refrigerant fluid is propane and the engine fluid is butane.

4. The refrigeration system of claim 1 further comprising a heat source, where the heat source supplies heat to the boiler.

5. The refrigeration system of claim 4 where the heat source is solar heat.

6. The refrigeration system of claim 4 where the heat source is waste heat.

7. The refrigeration system of claim 1 where the diaphragm assembly comprises:

the diaphragm;

a refrigeration side cylinder head;

an engine side cylinder head;

a refrigeration side valve, where the refrigeration side valve is in fluid communication with the refrigeration side cylinder head, the refrigeration side condenser, and the evaporator such that the refrigeration side valve controls whether fluid may travel from the evaporator to the refrigeration side cylinder head or from the refrigeration side cylinder head to the condenser; and an engine side valve, where the engine side valve is in fluid communication with the engine side cylinder head, the engine side condenser, and the boiler such that the engine side valve controls whether fluid may travel from the boiler to the engine side cylinder head or from the engine side cylinder head to the condenser, where the diaphragm is located between and sealingly separates the refrigeration side cylinder head and the engine side cylinder head.

8. The refrigeration system of claim 1 further comprising a gravity flow system between the engine side condenser and the boiler.

9. A method of using heat to power a refrigeration system, the system comprising:

a refrigeration side, the refrigeration side comprising:

an evaporator;

a condenser; and a refrigerant fluid;

a heat engine side, the heat engine side comprising:

a boiler;

a condenser; and an engine fluid; and a diaphragm assembly between the refrigeration side and the heat engine side, the diaphragm assembly comprising:

a diaphragm;

a refrigeration side cylinder head;

an engine side cylinder head;

a refrigeration side valve, where the refrigeration side valve is in fluid communication with the refrigeration side cylinder head, the refrigeration side condenser, and the evaporator such that the refrigeration side valve controls whether fluid may travel from the evaporator to the refrigeration side cylinder head or from the refrigeration side cylinder head to the condenser; and an engine side valve, where the engine side valve is in fluid communication with the engine side cylinder head, the engine side condenser, and the boiler such that the engine side valve controls whether fluid may travel from the boiler to the engine side cylinder head or from the engine side cylinder head to the condenser, where the diaphragm is located between and sealingly separates the refrigeration side cylinder head and the engine side cylinder head;

where:

on the refrigeration side, the evaporator is in fluid communication with the diaphragm assembly, the diaphragm assembly is in fluid communication with the condenser, and the condenser is in fluid communication with the evaporator such that the refrigerant fluid flows from the evaporator to the diaphragm assembly, from the diaphragm assembly to the condenser, and from the condenser to the evaporator;

on the heat engine side, the boiler is in fluid communication with the diaphragm assembly, the diaphragm assembly is in fluid communication with the condenser, and the condenser is in fluid communication with the boiler such that the engine fluid flows from the boiler to the diaphragm assembly, from the diaphragm assembly to the condenser, and from the condenser to the boiler; and where the diaphragm separates the refrigerant fluid from the engine fluid in the diaphragm assembly, where the diaphragm is flexible such that when the refrigerant fluid has a higher pressure than the engine fluid, the diaphragm forces the engine fluid out of the diaphragm assembly and when the engine fluid has a higher pressure than the refrigerant fluid, the diaphragm forces the refrigerant fluid out of the diaphragm assembly;

the method comprising:

applying heat to the boiler;

heating the engine fluid with the boiler;

moving the engine side valve to allow the engine fluid to flow from the boiler to the diaphragm assembly and simultaneously moving the refrigeration side valve to allow the refrigerant fluid to flow from the diaphragm assembly to the refrigeration side condenser;

allowing the pressure of the heated engine fluid to move the diaphragm to a first position, forcing refrigerant fluid out of the diaphragm assembly to the refrigeration side condenser;

moving the engine side valve to allow the engine fluid to flow from the diaphragm assembly to the engine side condenser and simultaneously moving the refrigeration side valve to allow the refrigerant fluid to flow from the evaporator to the diaphragm assembly;

allowing the pressure of the refrigerant fluid to move the diaphragm to a second position, forcing engine fluid out of the diaphragm assembly to the engine side condenser;

allowing the engine fluid to return to the boiler; and repeating all steps.

10. The method of claim 9 where the refrigerant fluid and the engine fluid are related such that the refrigerant fluid has a higher pressure at the evaporator than the engine fluid has at the condenser and the engine fluid has a higher pressure at the boiler than the refrigerant fluid has at the condenser.

11. The method of claim 10 where the refrigerant fluid is propane and the engine fluid is butane.

* * * * *